US010371491B2

(12) United States Patent
Bynum, Jr.

(10) Patent No.: US 10,371,491 B2
(45) Date of Patent: Aug. 6, 2019

(54) GAMING SYSTEM USING PROJECTILE AND TARGET

(71) Applicant: Stanley A. Bynum, Jr., Denton, TX (US)

(72) Inventor: Stanley A. Bynum, Jr., Denton, TX (US)

( * ) Notice: Subject to any disclaimer, the term of this patent is extended or adjusted under 35 U.S.C. 154(b) by 0 days.

(21) Appl. No.: 13/787,695

(22) Filed: Mar. 6, 2013

(65) Prior Publication Data

US 2014/0256479 A1 Sep. 11, 2014

Related U.S. Application Data

(60) Provisional application No. 61/772,901, filed on Mar. 5, 2013.

(51) Int. Cl.

| | |
|---|---|
| ***F41J 3/00*** | (2006.01) |
| ***F42B 6/00*** | (2006.01) |
| ***F42B 6/06*** | (2006.01) |
| ***F42B 6/08*** | (2006.01) |

(52) U.S. Cl.

CPC ..... *F42B 6/08* (2013.01); *F41J 3/0004* (2013.01); *F41J 3/0033* (2013.01); *F42B 6/003* (2013.01); *F42B 6/06* (2013.01)

(58) Field of Classification Search

CPC F41J 3/0033; F41J 3/0004; F42B 6/08; F42B 6/06; F42B 6/003

USPC ..... 473/470, 577

See application file for complete search history.

(56) References Cited

U.S. PATENT DOCUMENTS

| | | | | | |
|---|---|---|---|---|---|
| 397,950 | A * | 2/1889 | White | F42B 6/08 | 248/205.5 |
| 735,415 | A * | 8/1903 | Schrodel | F42B 6/04 | 16/84 |
| 2,970,838 | A * | 2/1961 | Taggert | F42B 6/04 | 124/41.1 |
| 3,110,336 | A * | 11/1963 | Sukala, Jr. | F42B 6/08 | 150/154 |
| 3,997,162 | A * | 12/1976 | Scullin | A63F 9/0208 | 273/271 |
| 4,266,781 | A * | 5/1981 | Blue | 473/585 | |
| 4,881,743 | A * | 11/1989 | Fiorenzo | 473/577 | |
| 4,946,172 | A * | 8/1990 | Wong | F42B 6/003 | 473/585 |
| 5,669,836 | A * | 9/1997 | Hill | F42B 6/08 | 473/574 |

(Continued)

OTHER PUBLICATIONS

Webpage download, Soapqueen2011 2011, www.soapqueen.com/bath-and-body-tutorials/tips-and-tricks/how-to-shrink-wrap-soap/, 3 pages.*

*Primary Examiner* — Jeffrey S Vanderveen

(74) *Attorney, Agent, or Firm* — Braxton Perrone, PLLC

(57) ABSTRACT

A gaming system comprised of an elongated projectile and a target for said projectile to be projected into. The system includes a projectile and a target. The projectile has a head, an elongated shaft coupled to the head, and a tail coupled to a rear end of the shaft. The tail has a mechanical adapter for coupling the projectile to a projecting device. The head has a shock absorber coupled to a penetration prevention device. The head prevents the projectile from penetrating into a target. The target has at least one aperture located on the external surface of the target and an immobilizer for immobilizing a projectile which has entered the aperture.

8 Claims, 6 Drawing Sheets

(56) References Cited

U.S. PATENT DOCUMENTS

| | | | | |
|---|---|---|---|---|
| 6,142,895 | A * | 11/2000 | Jason | F42B 12/40 473/577 |
| 6,159,117 | A * | 12/2000 | Chan | 473/574 |
| 8,852,038 | B1 * | 10/2014 | Hyde | F42B 6/04 473/578 |
| 2006/0014598 | A1 * | 1/2006 | Martin | 473/578 |
| 2006/0135298 | A1 * | 6/2006 | Yang | 473/572 |
| 2007/0026978 | A1 * | 2/2007 | Martin | 473/578 |
| 2009/0111620 | A1 * | 4/2009 | Seales et al. | 473/570 |
| 2011/0214653 | A1 * | 9/2011 | Lyon | 124/23.1 |
| 2013/0123051 | A1 * | 5/2013 | Pierce et al. | 473/577 |
| 2014/0256479 | A1 * | 9/2014 | Bynum, Jr. | 473/470 |

* cited by examiner

GAMING SYSTEM USING PROJECTILE AND TARGET

CROSS REFERENCE TO RELATED APPLICATIONS

This application claims the benefit of U.S. Provisional Application No. 61/772,901 entitled "Gaming System Using Projectile and Target," filed Mar. 5, 2013, the entirety of which is incorporated herein by reference.

BACKGROUND OF THE INVENTION

Technical Field

The present invention relates to the use of projectiles, including archery, and games using projectiles.

Description of Related Art

Archery, spear-throwing, and dart-throwing all involve an elongated projectile with a pointed front end being projected at a penetrable target. Devices currently in the art and available for sale include arrows, spears, javelins, and darts designed for the purpose of hunting and marksmanship, using front tips on the projectiles that are sharp enough to offer sufficient penetrating ability, so that when projected at sufficient speed at a penetrable target, the projectile penetrates the surface of the target. The inanimate targets used to promote marksmanship are typically of a rigid or semi-rigid material, such as rubber, foam, wood, plastic or paper, and when hunting, the targets are animals. In all such cases, the devices are collectively classifiable as deadly weapons to one skilled in the art.

The problems with using such projectiles in games are: the danger of the projectiles when used in proximity with humans, animals or other penetrable surfaces, and the resulting necessary concerns of space that are required, such as zones of fire, impact zones, firing or throwing lines, and a strict adherence of participants to the times that such zones are safe or unsafe for occupation. These concerns are for the safety of participants but create real economic consequences as the games can then only be played on tracts of land, in rooms or in buildings that are of sufficient size and that contain sufficiently predictable or controlled human traffic, and play of such games is limited by the time concerns created by the buffer between projectile projection and projectile retrieval. These methodologies, though necessary for the safety and well-being of participants in such games and contests, do not comply with other customary categories of gameplay that use less dangerous projectiles. Consequently, there is a need for a safe projectile as well as a safe game or games which utilize projectiles.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

In one embodiment a new game system is disclosed, wherein the game system is comprised of a projectile and a target. This game system takes into account the drawbacks of the prior art and advances the fields of archery and related projectile-throwing systems. Furthermore, it evolves the fields of many other game categories to which the system may be adapted, such as archery golf, underwater sling polo, and atlatl Ultimate.

In one embodiment, the system includes a projectile that does not penetrate targets, but retains requisite properties for use with appurtenant projecting devices. In one embodiment the system reduces impact force at the front end of the projectile and at the back end of the projectile, rendering the flying projectile non-deadly. The system, in one embodiment, is useful in games and competitions around humans, animals and penetrable surfaces when projected using devices and techniques adapted from traditional archery and related sports, such as being thrown by hand, using bows, atlatls, slings, slingshots, blow guns, or combinations thereof.

In one embodiment, discussed in more detail below, the system further comprises a target or goal for the projectile to be projected into. In one embodiment, given a non-penetrating projectile, the competitive necessity of a definition of successful projection must be established. In traditional archery, the surface of a penetrable target may have various zones of scoring, such as a bullseye or multiple dots, and in games and competitions, the determined accuracy of the participant's efforts may result in a numeric score. Since a penetrating projectile, upon impact, is physically affixed to the target, judging the accuracy of the shot relative to the desired zone or point of the target, is a simple matter of visually inspecting the penetrated projectile. However, a target intended to be used with a non-penetrating projectile would not result in affixation of the projectile into the visible surface of the target. In one embodiment a ready method of scoring the accuracy uses the passage or the projectile into one or more apertures, with a device or method for verifying that the projectile passed through the aperture, such as by trapping the projectile or channeling it to a reservoir that immobilizes the projectile. A non-penetrating projectile, thus immobilized, can subsequently be judged for accuracy of the shot.

Figure 1A:
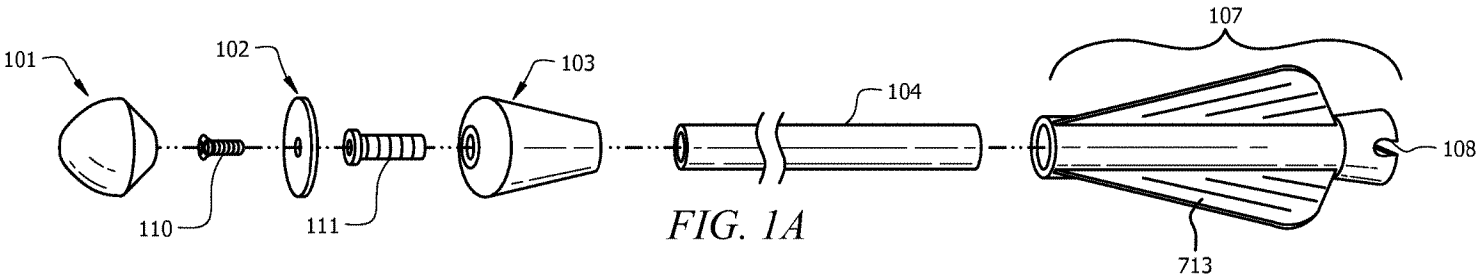
FIG. 1A shows an exploded view of a projective in one embodiment.
Figure 1B:
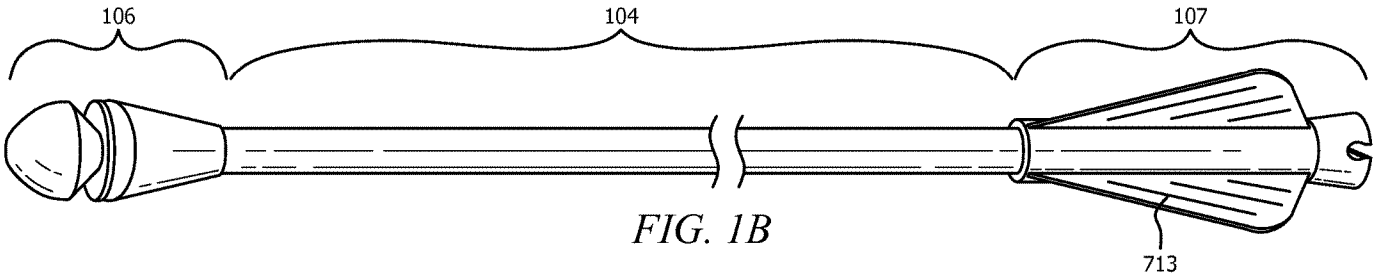
FIG. 1B shows a side view of the projectile of FIG. 1A in one embodiment.

Turning now to FIG. 1A, FIG. 1A shows an exploded view of a projectile in one embodiment. FIG. 1B shows a side view of the projectile of FIG. 1A in one embodiment. FIG. 1B shows a projectile 100 which comprises a head 106, an elongated shaft 104, and a tail 107.

As depicted, the head 106 comprises a shock absorber 101, a penetration prevention plate 102, and a cuff 103. The head 106 is coupled to the front end of the shaft 104 via any method or device known in the art. The shaft is further coupled to the tail 107, which as illustrated, comprises a mechanical adapter 108 for coupling the projectile 100 to a projection device.

The projectile 100 can comprise a variety of items, including but not limited to, arrows, spears, javelins, and darts. The projectile can comprise virtually any elongated instrument which is thrown, slung, or otherwise projected into the air.

The projectile 100 is projected by a projection device (not shown). The projection device can include, but is not limited to a bow, sling, atlatl, blowgun, a human hand, etc. Virtually any device which can project a projectile can be a projection device. In one embodiment, the projectile 100 can be utilized with existing projection devices. Put differently, if the projectile 100 comprises an arrow, in one embodiment the arrow can be utilized with a bow without modification to the bow.

As noted, in one embodiment the projectile 100 comprises a shock absorber 101. A shock absorber 101 comprises a device which absorbs shock upon impact, thereby increasing the duration of impact and reducing impact force.

The shock absorber 101 can comprise a variety of materials including foam, air or other fluid, elastomeric compounds, a spring, a piston and cylinder, etc. In operation, the shock absorber 101 absorbs the force of impact and slows the projectile 100, effectively reducing force transmitted to the target or any persons, animals or penetrable objects.

The shock absorber 101 can comprise virtually any shape including but not limited to spherical, conical, conicofrustal, conicofrustal with a convex or concave face, ovoidal, dome, cylindrical, oblate spheroid, prolate, etc. Each shape can affect the aerodynamic flight of the projectile 100. Further, the shape affects the mass of the projectile 100. The shape can be adjusted depending on the desired application. In another embodiment the shock absorber 101 comprises a highly elastic compound such as urethane, latex, silicone, isoprene, chloroprene, nitrile, and combinations thereof. In one embodiment the shock absorber 101 comprises an elastic compound in a hemispheric, conical, rounded conical or hemiellipsoidal fore section with a conicofrustal aft section.

Just as the rigidity of the materials within the shock absorber 101 affects the ability to absorb force, the geometry of the shock absorber 101 can vary to adjust the rate of force absorption. For example, a shock absorber 101 with a conical shape concentrates the initial force at a smaller point. After collision, the impact force is spread out along the increasing diameter of the cone.

As noted, the shock absorber 101 can comprise a foam or elastomeric material. The shock absorber 101 can also comprise a fluid such as air or water. For example, the shock absorber 101 can comprise a balloon filled with water, air, or other such fluid. The balloon absorbs the force upon impact and slows and eventually stops the projectile 100. Aside from a balloon, the shock absorber 101 can also comprise a piston filled with a fluid. In such an embodiment the movement of a rod within a piston is controlled by a fluid. Upon impact the rod advances within the piston but the movement is slowed because of the fluid. In one embodiment, the piston comprises a spring or other such material which provides a force to counter the momentum of the rod and projectile 100. In one embodiment the piston comprises an elastomeric material which aids in slowing the rod. In another embodiment a combination of fluids, springs, and/or elastomeric materials are used in the piston. In still other embodiments a combination of two or more pistons and cylinders are utilized.

As noted, in one embodiment, the shock absorber 101 helps slow the flight of the projectile. However, depending upon the momentum of the projectile, a shock absorber 101 alone may be insufficient to prevent the projectile 101 from penetrating a target. In fact, if the projectile has significant momentum, the projectile's 101 momentum can overcome the shock absorber's 101 ability to absorb force such that the shaft 104 penetrates the target. Accordingly, in one embodiment the projectile 100 further comprises a penetration prevention device 102. A penetration prevention device 102 as used herein is a device which comprises a flat and rigid impact surface located on the head of the projectile 100, wherein the flat surface is oriented perpendicular to the direction of flight. The penetration prevention device 102 in one embodiment, comprises a diameter greater than the diameter of the shaft 104. In one embodiment the ratio of the penetration prevention device 102 outer diameter to the shaft's 104 outer diameter is about 1.5:1 to 20:1. In another embodiment the ratio is between about 1.5:1 to 5:1, and in still another embodiment the ratio is between about 1.5:1 to 3:1. Because the penetration prevention device 102 is a device which comprises a flat surface and has greater surface area compared to the shaft in the area parallel to the plane of the target, the penetration force required to penetrate a target is very significantly increased.

The penetration prevention device 102 can comprise a plate or washer of virtually any shape or size. For example the penetration prevention device 102 can be relatively flat and comprise a circular shape, triangular shape, as well as the shape of virtually any polygon. In one embodiment the penetration prevention device 102 can comprise the shape of an ellipsoid such as a lentricular disk or hyperboloids including convex, concave, combinations of both concave and convex and all cylindrical shapes. In one embodiment two or more penetration prevention devices 102 are utilized.

In one embodiment the penetration prevention device 102 comprises one or more holes. Such holes provide several benefits. First, in the event that the holes are exposed to airflow, holes affect the aerodynamics of the projectile 100. Providing holes on the surface of the projectile 100 which encounter airflow allows the aerodynamics to be better controlled. Second, holes reduce the mass of the penetration prevention device 102. The momentum of a projectile is a function of the object's mass and velocity. By reducing the mass of the object, the momentum, and thus, the force required to stop the object, is reduced. Thus, utilizing holes in the penetration prevention device 102 reduces the mass of the projectile 100 and thus reduces the momentum of the projectile 100. Likewise, the penetration prevention device 102 can further comprise notches at the edges. Such notches also provide a way to reduce mass of the projectile.

The penetration prevention device 102 can be coupled to the shock absorber 101 via any method or device known in the art. In one embodiment the shock absorber 101 is coupled to the penetration prevention plate 102 via a screw. In one embodiment, the head of the screw is recessed within the penetration prevention plate 102. A recessed screw minimizes the amount of sharp objects which could undesirably penetrate the target.

Figure 2:
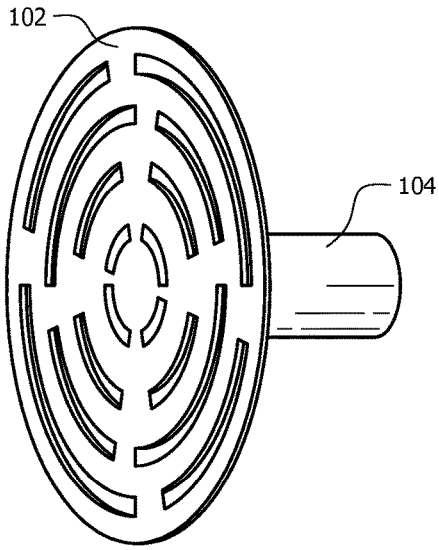
FIG. 2 depicts a perspective view of the penetration prevention plate comprising holes in one embodiment.

In another embodiment, the penetration prevention plate 102 is coupled to the shock absorber 101 via adhesives, glue, or the like. As noted above, in one embodiment the penetration prevention plate 102 comprises holes. FIG. 2 is a perspective view of the penetration prevention plate comprising holes in one embodiment. Aside from the mass and aerodynamic benefits discussed above, in one embodiment the holes increase the adherence of the shock absorber 101 to the penetration prevention device 102. Holes allow the rubber or plastics of the shock absorber 101 to mold into the penetration prevention plate 102. As such, holes act as anchor points which increases adherence between the shock absorber 101 and the penetration prevention plate 102.

Figure 3:
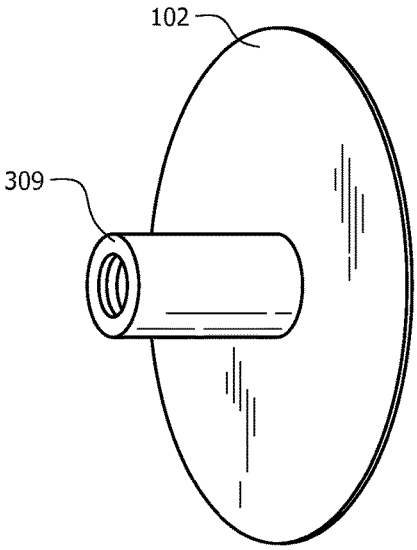
FIG. 3 depicts a perspective view of a penetration prevention device comprising a base in one embodiment.

The penetration prevention device 102 can be coupled to the cuff 103 and/or the shaft via any method or device known in the art including but not limited to screws, bolts, etc. FIG. 3 depicts a perspective view of a penetration prevention device 102 comprising a base in one embodiment. As depicted, the penetration prevention device 102 comprises a base 309 to which the shaft 104 and/or the cuff 103 couple. For example, the base 309 can comprise either male or female threading for coupling. The base 309 can be affixed to the penetration prevention device 102 or the base 309 can be integrally made.

In one embodiment the penetration prevention device 102 is integrally made with the shaft 104. Such an embodiment minimizes the number of parts required for manufacturing of the projectile 100 decreasing manufacturing costs and time to manufacture.

As depicted in FIG. 1A, the penetration prevention device 102 is coupled to the shaft 104 via a dual threaded screw 111 and a single threaded screw 110. However, this example is not limiting as any coupling device or method can be utilized. As depicted, the dual threaded screw 111 has internal threads as well as threads on the external surface. The dual threaded screw 111 screws into either the cuff 103 or the shaft 104. The single threaded screw 110 screws into the dual threaded screw 111 securing the penetration prevention plate 102. As noted, in one embodiment the single threaded screw 110 is recessed within the penetration prevention plate 102. A dual threaded screw 111 has several advantages including the elimination of parts. Because the dual threaded screw 111 acts as both a female fitting and a male fitting, there is no need for an adapter or coupler. Thus, this results in the elimination of additional parts. Because the projectile 100 is projected into the air, the elimination of additional parts results in increased safety as accidentally dislodged parts pose a safety risk.

Figure 1C:
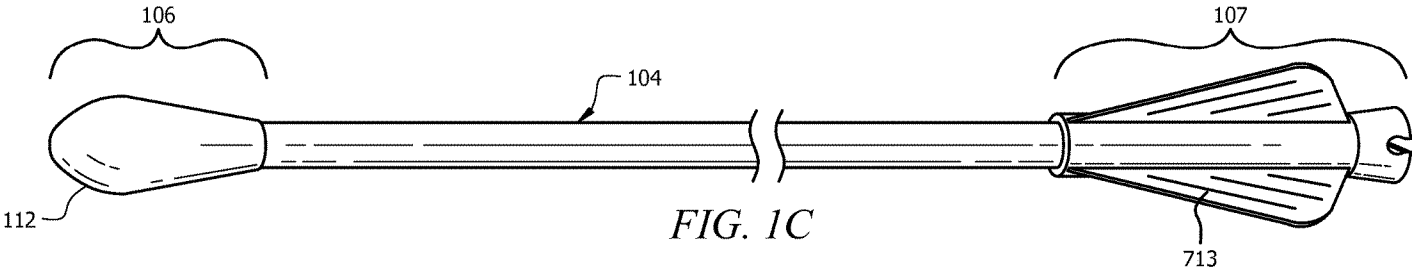
FIG. 1C shows an assembled projectile with a sheath in one embodiment.

In one embodiment the head 106, or at least a portion of the head 106, is covered in a sheath 112. FIG. 1C shows an assembled projectile with a sheath 112 in one embodiment. The sheath 112 serves several purposes. First, it acts as a protective coating to protect the head 106. Second, it prevents pieces within the head 106 from becoming dislodged which could injure participants or bystanders. Thus, the sheath 112 results in increased safety. Third, the sheath 112 provides an additional layer to absorb the force of impact.

The sheath 112 can comprise any material including plastic or rubber. In one embodiment the sheath 112 comprises urethane rubber, chloroprene rubber, silicone rubber, ABS plastic, carbon, and combinations thereof. In one embodiment, the sheath 112 is molded around the head 106. The sheath 112 can comprise any shape described herein and includes but is not limited to teardrop, spherical, ovoid, ellipsoid, blunt Von Kármán, reverse ovoid, etc. Such shapes have a rear shape such that the sheath tapers downward to meet the shaft 104. The tapering results in an aerodynamic advantage as it helps the projectile 100 fly straight.

Referring back to FIG. 1A, in some embodiments the projectile 100 comprises a cuff 103. A cuff 103, as used herein, refers to a device that reduces mass and reinforces the head 106. As an example, as noted above, in some embodiments the sheath 112 is molded around the head 106. In some embodiments, the sheath 112 utilizes a filler to ensure the sheath 112 has adequate support. However, filling the sheath 112 with a material such as rubber results in a head 106 which is too heavy. The flight of the projectile 100 thus suffers. However, a cuff 103 allows the sheath 112 to be reinforced while minimizing mass. Thus, the volume underneath the sheath 112 is filled making a more stable head 106 while adding minimal mass. The cuff 103 can comprise the same material or different material as the shock absorber 101. The cuff 103 can comprise a fluid, elastomeric material, foam, etc. In one embodiment the cuff can comprise a thin shell which is hollow and filled with air or another fluid. The cuff 103 can comprise a solid or hollow, rigid or semi-rigid impact resistance polymer such as ABS plastic. It can comprise any shape described herein, but in one embodiment comprises a conicofrustal, double conicofrustal, conicofrustal with a convex or concave face, or a ovoidal shape, as well as combinations thereof. In another embodiment, the cuff 103 comprises a conical shape. In one embodiment the rear of the cuff 103 provides the sheath 112 with its shape. In one embodiment the rear of the cuff tapers downward to meet the shaft 104.

In one embodiment the cuff 103 comprises channels. Channels are holes which have been placed, such as by drilling, etching, molding, etc., into a surface. As noted, channels reduce the weight of the cuff 103. Channels can be used in the head 106, the tail 107, and the shaft 104 to reduce the mass of the projectile 100 also as a way to control and/or modify the aerodynamics of the projectile 100.

Figure 4:
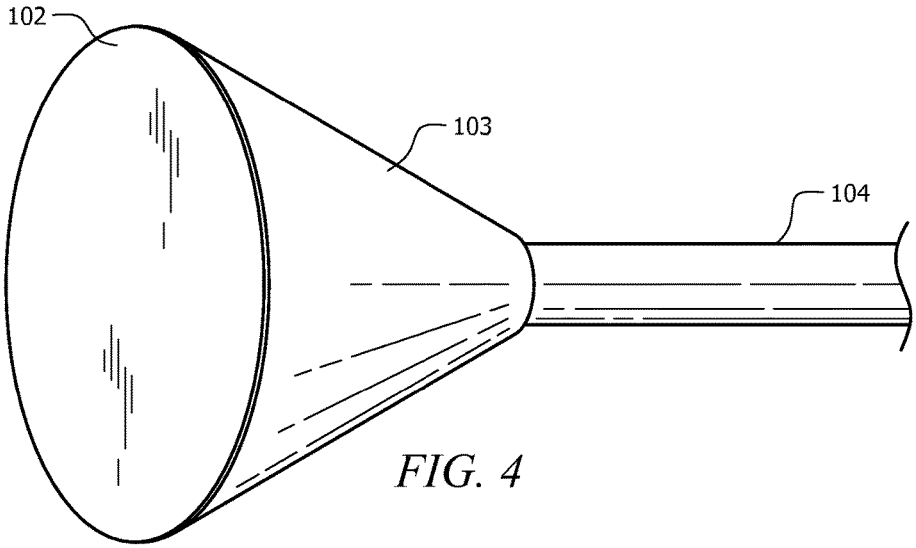
FIG. 4 depicts a perspective view of an integral penetration prevention device and cuff.

In one embodiment an integral penetration prevention device 102 and cuff 103 is utilized. FIG. 4 is a perspective view of an integral penetration prevention device 102 and cuff 103. In such an embodiment, the penetration prevention device 102 is at the front of the piece whereas the cuff 103 extends from the penetration prevention device 102 to the rear where it couples to the shaft 104. In other embodiments the penetration prevention device 102 and the cuff 103 are not integral but are simply coupled. As noted, in one embodiment the cuff 103 comprises a tapered shape which tapers from a larger diameter to a smaller diameter where the cuff couples to the shaft. As previously noted, the tapering aids in the flight of the projectile 100.

Figure 5A:
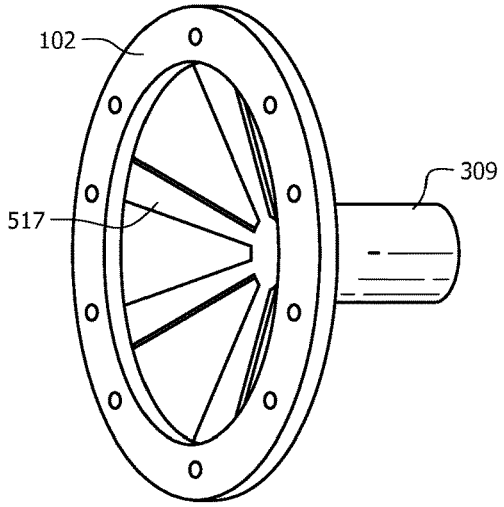
FIG. 5A depicts a perspective view of a penetration prevention device comprising spokes in one embodiment.

FIG. 5A depicts a perspective view of a penetration prevention device comprising spokes 517 in one embodiment. While FIG. 3 shows an embodiment wherein the base 309 couples directly adjacent to the penetration prevention device 102, this embodiment is for illustrative purposes and is not limiting. FIG. 5A shows an embodiment wherein the base 309 is separated from the penetration prevention device 102 via spokes 517. The spokes 517 can comprise any material discussed herein and couple the penetration prevention device 102 to the base 309 or the shaft 104. There can be any number of spokes including one, to more than one. As depicted, the penetration prevention device 102 is an annular circle comprising an aperture in its center. In one embodiment the inner diameter is between about 0.5 and about 5 times the diameter of said shaft 104. In one embodiment, the outer diameter is between about 1.1 and about 3 times the inner diameter. In one embodiment the width of the annular circle is between about 0.1 and about 1 times the diameter of the shaft 104. While the shape has been described as circular, this is for illustrative purposes and should not be deemed limiting.

Figure 5B:
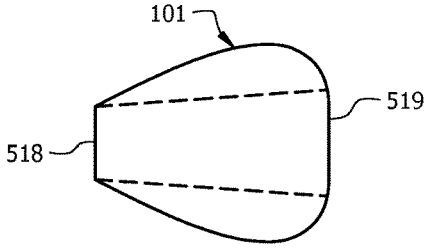
FIG. 5B shows a perspective view of s shock absorber in one embodiment.

As depicted, the penetration prevention device 102 comprises holes. As noted, holes help the shock absorber 101 to adhere. FIG. 5B shows a perspective view of s shock absorber in one embodiment. The shock absorber 101 can comprise any material or shaped discussed herein. In one embodiment the shock absorber 101 comprises a shape of an annular cylinder, elliptical torus, elongated torus, torodial, etc. In one embodiment the material comprises urethane, latex, silicone, isoprene, chloroprene, and/or nitrile, and combinations thereof. As depicted, the shock absorber 101 comprises an annular shape meaning it comprises a hollow cavity. The front end comprises a first open diameter 518 and the back end comprises a second open diameter 519. In one embodiment, the first open diameter 518 is less than said second open diameter 519. As will be discussed, in one embodiment, the second open diameter 519 is sized to be approximately equal to the diameter of the cavity for the penetration prevention device 102. While the shape has been discussed as annular, this is for illustrative purposes and should not be deemed limiting.

Figure 5C:
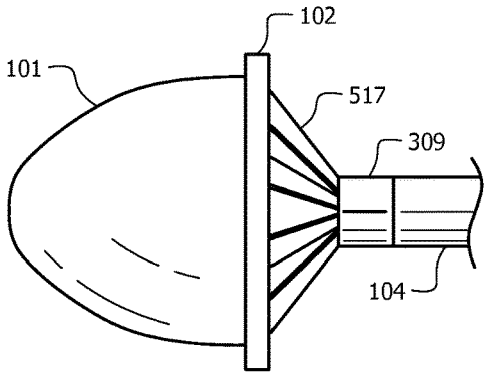
FIG. 5C shows a side view of the shock absorber of FIG. 5B mated with the penetration prevention device of FIG. 5A.

FIG. 5C shows a side view of the shock absorber of FIG. 5B mated with the penetration prevention device of FIG. 5A. The shock absorber 101 can be mated or coupled with the penetration prevention device 102 via any method or device discussed herein. In embodiments wherein the shock absorber 101 comprises an annular shape, air is allowed to flow through the first open diameter 518, through the second open diameter 519, and through the cavity of the penetration prevention device 102. This ability provides yet another opportunity to control and adjust aerodynamics. Further, the annular shape provides an opportunity to reduce the mass of the head 106, and thus, the projectile 100.

Figure 6:
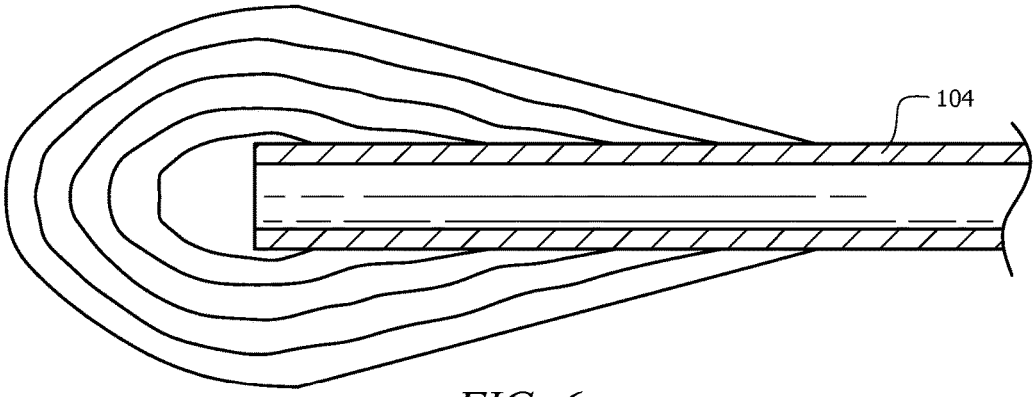
FIG. 6 shows a cross-section of a shock absorber which comprises variable-rigidity layers in one embodiment.

In one embodiment the head 106 comprises variable-rigidity layers. FIG. 6 is a cross-section of a head 106 which comprises variable-rigidity layers in one embodiment. A variable-rigidity layer is a material which comprises at least two layers which comprises different rigidity. In one embodiment, and as depicted, the head 106, located at the fore end of the shaft, is coated in layers of one or more elastomeric compounds of varying levels of elasticity. The layers, in one embodiment, are ordered, according to level of elasticity, palindromically, wherein the layer of elastomeric compound nearest to the shaft 104 are the least elastic, therefore providing high adhesion to the body of the shaft and high resistance to abrasion by kinetic vibration of the body of the shaft, but low shock absorption. The next adjacent layer is of moderate elasticity, followed by a highly elastic layer, then a layer of moderate elasticity, and finally, an exterior layer of low elasticity, providing high resistance to abrasion by exterior objects upon impact of the projectile with targets. Using this arrangement of the elastomeric compound(s) into palindromic levels of elasticity, from lowest to highest to lowest, the utility of the head 106 of the projectile 100 is improved, with respect to shock absorption and penetration prevention. In one embodiment, because the variable-rigidity layers make contact with the shaft 104 along the sides of the shaft 104, compared to only the front end of the shaft 104, the penetration prevention qualities are increased; the variable-rigidity layers grip the shaft at the front and the sides and slow and stop the projectile 100.

In the embodiment depicted in FIG. 6, the penetration prevention device 102 and the shock absorber 101 are replaced by the variable-rigidity layers. Thus, the variable-rigidity layers function as both the penetration prevention device 102 and the shock absorber 101. In still other embodiments the variable-rigidity layers are used in conjunction with a shock absorber 101 and/or penetration prevention device 102. For example, in one embodiment the sheath 112 comprises variable-rigidity layers. In such embodiments, the benefits of the variable-rigidity layers supplement rather than replace the benefits of the shock absorber 101 and/or the penetration prevention device 102. In one embodiment, upon impact, the front of the head 106 deforms to become flatter. Such deformation results in greater surface area.

In one embodiment, the outer layer is softer whereas the inner layer is harder. In such an embodiment the outer layer absorbs and softens the impact whereas the inner layer offers more resistance. In still another embodiment the outer most layer and the inner most layer are hard, and adjacent to a hard layer is a medium rigidity layer. Sandwiched between the medium rigidity layers is a soft layer. Such an embodiment provides for the impact force to be absorbed. While the variable-rigidity layers has been described with reference to the shock absorber 101, the variable-rigidity layers can also be utilized in the cuff 103 and/or the sheath 112, both discussed below.

As noted the head 106 is coupled to the shaft 104. The shaft 104 can comprise any elongated tube. The shaft 104 can be hollow or it can be filled. It can comprise virtually any material including polymer, plastic, fiberglass, wood, carbon, aluminum, etc. The size of the shaft 104 can vary depending on the desired application. In one embodiment the diameter of the shaft 104 ranges from about 2 mm, for a blow dart for example, to about 60 mm for a spear, for example. In other embodiments the diameter ranges from about 2 mm to about 20 mm, and in still another embodiment the diameter ranges from about 5 mm to about 15 mm. The length of the shaft 104 also varies depending on the desired application. In one embodiment the length ranges from about 2 cm to about 300 cm. In another embodiment the length of the shaft 104 ranges from about 3 cm to 6 cm. In still another embodiment the length ranges from about 250 cm to about 300 cm. In still other embodiments the length ranges from about 70 to 100 cm.

The shaft 104 is coupled to a tail 107. The shaft 104 can be coupled to the tail 107 with any device discussed herein. In one embodiment the tail 107 is coupled to a single threaded screw which couples to a dual threaded screw which screws into the shaft 104. In other embodiments the tail 107 is coupled with a direct mold. In one such embodiment the tail 107 is molded directly to the aft of the shaft 104. In one embodiment the tail 107 is affixed to the shaft 104 with an adhesive compound.

In one embodiment, the tail 107 comprises a mechanical adapter 108 which couples the projectile 100 with the projecting device. The mechanical adapter 108 can include any object which allows the projecting device to project the projectile 100. Thus, for example, if the projecting device is a bow, then the mechanical adapter 108 comprises a nock to receive the bow string. If the projectile is a blow dart, the mechanical adapter 108 comprises a funnel for receiving a burst of air or other fluid. The mechanical adapter 108 can comprise a slingshot adapter, an atlatl adapter, including convex and concave adapters, an adapter for an underwater projector, a coarse sling adapter, an inverted cone adapter, a flat tab adapter, or a blowgun adapter.

As depicted in FIG. 1, the projectile 100 also comprises a flight drag 713. A flight drag 713 is a device which is added to control and stabilize the projectile 100 during flight. Flight drags 713 help the projectile 100 to fly straight. Examples of flight drags 713 include, but are not limited to, fletches, flu-flus, inverted fletches, processes from the surface of the shaft, a solid cone with channels voided along the axis of the shaft, tubules, linked or otherwise secured ribbons, flared fletches, hooked fletches, corkscrew fletches, and virtually any fletches known in the art. For example, the projectile 100 can have raised surfaces such as bumps, or the surface can have etching. Bumps and etching provide a simple way to control and alter the aerodynamics of the projectile 100. In one embodiment the projectile 100 comprises one or more flight drags 713. As depicted in FIG. 1, fletches are added to the head 107. While FIG. 1 depicts the flight drag 713 as extending upward from the surface of the tail 107, in other embodiments the flight drag 713 comprises channels which are etched into the surface of the tail 107. Further, while FIG. 1 depicts the flight drag 713 being located on the tail 107, flight drags 713 are not so limiting. In other embodiments the flight drag 713 is located on the shaft. In still other embodiments, a flight drag 713 is located on the head 106.

While in some embodiment the flight drag 713 comprises an object which is affixed to the projectile, in other embodiments portions of the projectile 100 are shaped to operate as a flight drag 713. For example, while FIG. 1 depicts a tail 107 which has several flight drags 713 affixed thereto, in other embodiments the tail 107 is shaped to comprise a flight drag 713. As an example, in one embodiment the tail 107 is shaped to have fins which resemble and operate as a flight drag 713. In other embodiments, the head 106 is shaped to comprise the shape of a flight drag 713.

Figure 7A:
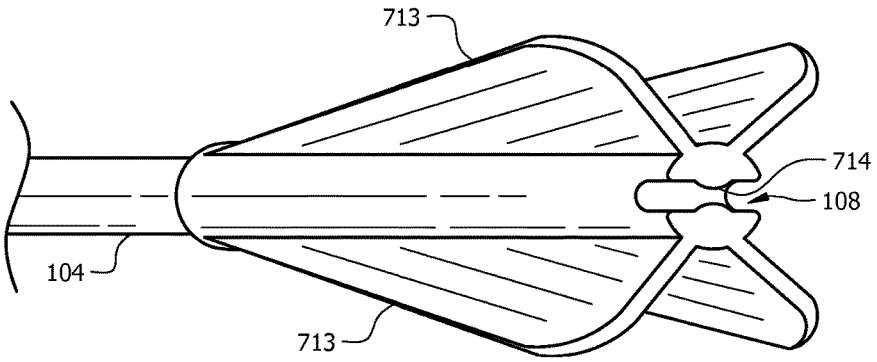
FIG. 7A depicts a rear perspective view of a tail comprising a flight drag in one embodiment.
Figure 7B:
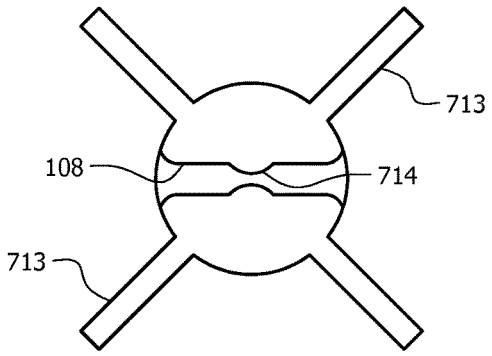
FIG. 7B depicts a rear view of the tail in FIG. 7A.
Figure 7C:
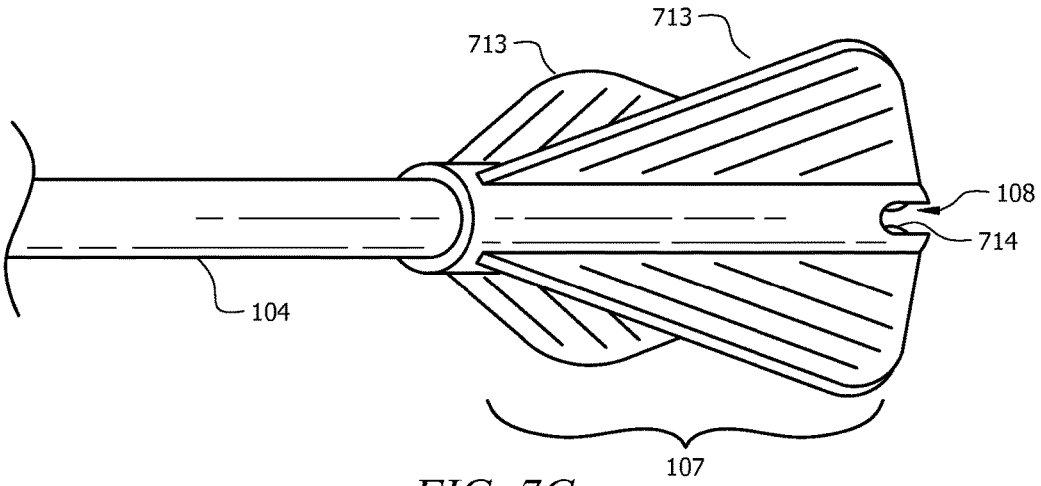
FIG. 7C depicts a front perspective view of the tail in FIG. 7A.

FIG. 7A depicts a rear perspective view of a tail comprising a flight drag in one embodiment. FIG. 7B depicts a rear view of the tail in FIG. 7A. FIG. 7C depicts a front perspective view of the tail in FIG. 7A. In the embodiments depicted in FIG. 7, the flight drags 713 are not simply affixed to the tail 107; instead, the tail 107 is shaped to have fins which function as a flight drag 713. In one embodiment, the tail 107 comprises a single integral piece which comprises all of the flight drags 713. Such an embodiments decreases parts required for manufacturing as a single part serves the function of the tail 107 and the flight drag 713. Further, some of such embodiments offer increased interchangeability as a tail 107 which comprises flight drags 113 can be utilized on other projectiles.

In one embodiment, the tail 107 comprises a bifurcation at the aft of the tail, the division of which is parallel to the shaft of the projectile 100 with hemispheric, cubic, parallelepipedal, or pyramidal process attached to the inside face of each prong of the bifurcation. In one embodiment the tail 107 further comprises clips 714. These clips 714, which are small protrusions inside the nock of the tail 107, further encompass the bowstring, ensuring contact with the bowstring during maximum string tilt at the apex of the draw.

As depicted in FIG. 7, the tail comprises a blunted end. Specifically, in one embodiment the mechanical adapter 108 comprises a blunted end. A blunted end is an end without sharp corners or edges. A blunted end can comprise a rounded or smooth end. Previous arrow nocks formed a sharp point which is undesirable. While the head 106 end of the projectile 100 is designed to be shot at an object, occasionally the head 106 end will ricochet off the ground or target and the projectile 100 will flip around such that the tail 107 end is in front of the head 106 end. If the tail 107 end is sharp or pointed, this can cause a safety risk. As such, in some embodiments the tail 107 end comprises a blunted end. A blunted end will soften the blow and limit the chance for the tail 107 end to penetrate a target, participant, or spectator. Thus, a blunted end increases the safety of the projectile 100.

In one embodiment, and as depicted in FIG. 7, the flight drag may have fletches, ridges, processes or fins, the aft terminus of which may be flush with one or more parts of the rear face of the nock or mechanical adapter 108. In one embodiment, the planar or near-planar junction of the rear of the fins with the rear of the mechanical adapter 108 increases the surface area of the rear of the projectile, further reducing impact force, and increasing safety in case that the projectile should be redirected from the intended flight path, and impact a surface with its rear end. Thus, in one embodiment the flight drag 713 extends all the way to the rear face of the projectile 100. In another embodiment, the flight drag 713 extends substantially all the way to the rear face of the projectile 100. As noted, because the flight drag 713 comprises a surface area, the presence of the flight drag 713 increases the total surface area of the rear face of the projectile 100 in the direction perpendicular to the direction of flight. Thus, if the rear end of the projectile 100 impacts a surface with its aft end, the surface area is increased on account of the flight drags 713. For example, FIG. 7B shows a rear face of a projectile 100 in one embodiment. It can be seen that because the end of the flight drag 713 is in substantially the same plane as the rear face of the projectile 100, the surface area of the projectile 100 is increased compared to a FIG. 7B which did not comprise flight drags 713. Consequently, the impact force is reduced. Such a reduction in impact force does not occur if the flight drag 713, for example, terminates at half an inch forward of the rear face.

In one embodiment the tail 107 comprises a nock with greater flare at the aft end of the nock and a convex face at the aft end.

In operation, the user loads the projectile 100 into the projecting device. The loading can be accomplished in the same manner normally performed. For example, if the projectile 100 is an arrow, the projectile 100 is loaded and a bow string is coupled to the mechanical adapter 108. The user then selects a target, aims the projectile 100, and releases the projectile 100. As noted, in one embodiment the projectile is a non-penetrating projectile. A non-penetrating projectile is a projectile which does not penetrate or get lodged within a typical archery target. A typical archery target is a paper target with a hay bale or other type of penetrable backing surface. A typical prior art arrow penetrates the paper target and the backing surface and becomes lodged in the backing surface. In one embodiment when shot at a prior art target which comprises a paper target and a hay bale backing surface, the projectile 100 with a shock absorber 101 and a penetration prevention device 102 punctures the paper target but does not penetrate the hay bale backing Instead, the projectile 100 collides with and bounces off the hay bale backing.

A typical prior art arrow has sufficient sectional density to penetrate its target which is typically either an animal or a paper target with a hay bale backing. As the fore tip of an arrow typically has a surface area of less than 0.1 $mm^2$, it can be assumed that a similar projectile, having a similar fore tip surface area, can also have sufficient sectional density to achieve penetration of the same target, ceteris paribus. In one embodiment, the projectile 100 presents a much larger fore tip diameter, and thus larger surface area, with the elastic quality of the head 106 deforming on impact to increase the impact surface yet further. Given the equation:

$$SD_{Ballistics} = \frac{F}{d^2} \approx p$$

with d being diameter of the projectile, F being the mass of the projectile, and p being pressure, a larger diameter will result in a lower sectional density (SD), and a poorer penetrative quality of the given projectile. In one embodiment, the surface area of the fore tip of the projectile 100 is between 2 and 10 $mm^2$. Accordingly, in such an embodiment, the sectional density is between 20 and 1,000, or even greater than 1,000 times poorer for the purpose of penetration of a similar target.

Although the sectional density is lower, this does not truly address penetration and injury of targets, especially that of humans. Because injury is to be avoided, in one embodiment, impact forces must be discussed. To address this, comparative impact forces are calculated to give reference to the force of one embodiment of the modified projectile 100. The formula for impact force is:

$$N=2\times m\times v/t$$

where m is mass of the projectile, v is velocity of the projectile, and t is the time duration of the impact of the projectile with its target. Force is expressed as N (Newtons).

With a typical golf ball, flying at a high drive speed of 90 meters per second, having a standard mass of 45.93 grams, and having a typical impact duration of 0.0007 seconds, the resulting impact force is approximately 12,000 N. This would be the force of a golf ball striking a target at short range, when projected at high (driving) speed.

With a typical American football, flying at a high thrown speed of 20 meters per second, having a standard mass of 430 grams, and having a typical impact duration of 0.1 seconds, the resulting impact force is approximately 190 N. This would be the force of a football striking a target at short range, when projected at high throwing speed.

In one embodiment, the modified projectile 100, flying at a high bow-projected speed of 60 meters per second, having a produced mass of 75 grams, and having a typical impact duration of 0.05 seconds, the resulting impact force is approximately 180 N. This is the force of one embodiment of the modified profile 100 striking a target at short range, when bow-projected at high speed. The above calculations give a frame of reference to the claim of non-penetration by the modified projectile 100, when projected at a typical speed.

Because the projectile 100, in one embodiment, is non-penetrating, the projectile 100 is much safer compared to prior art projectiles. Accordingly, the projectile 100 can be projected and used in smaller quarters and closer to people. Put differently, because in one embodiment the projectile 100 is non-deadly, it is safe to use the projectile 100 close to people. This decreases the amount of space required to safely shoot, either for target practice or in a game, a projectile 100.

As noted, in one embodiment, the projectile 100 can be projected with the same projecting device which shoots prior art projectiles. Thus, the same bow which shoots prior art arrows can shoot the modified projectiles 100. Accordingly, in one embodiment, the modified projectiles 100 experience the same or similar velocities as their prior art counterparts but still do not penetrate the target. In one embodiment, the modified projectiles 100 experience between a velocity between about 30 and 99% of their counterpart prior art velocities given the same method and force of projection. In another embodiment the velocity is between about 30% and 80% of the prior art velocities.

In one embodiment, the head 106 of the projectile 100 is shaped to be aerodynamically stable. In one embodiment, the modified projectile 100 has a similar flight pattern compared to their prior art counterpart.

As noted, the weight of the projectile 100 has an effect on the flight of the projectile. In one embodiment the weight of the projectile 100 is evenly distributed. In one example wherein the projectile comprises a blow dart, the head 106 weighs between about 1 to about 10 grams, or between about 1 and 5 grams for a blow dart. In another embodiment the head 106 weights about 2 grams. The ratio of the weight of the head to the weight of the rest projectile (weight of the projectile minus the weight of the head) ranges from about 1.1:1 to about 1.4:1 for a blow dart. In one example wherein the projectile comprises an spear, the head 106 weighs between about 100 and 200 grams, and in another embodiment weights about 150 grams. The ratio of the weight of the head to the weight of the rest projectile ranges from about 1.1:1 to about 1.4:1 for a spear. In another embodiment the ratio is about 1.25:1. In one example wherein the projectile comprises an arrow, the head 106 weighs between about 20-100 grams, and in another embodiment weighs between 25-65 grams. In one embodiment the ratio of the weight of the head to the weight of the rest of the projectile ranges from about 1.25:1 to about 4:1. While these ratios have been described in reference to one example, for example the ratios of the spear, these ratios can be applied to other objects as well. Put differently, the ratios given for one embodiment comprising a spear can also be utilized for embodiments using an arrow.

Because in some embodiments there is available space within the head 106, tail 107, and/or shaft 104 of the projectile 100, in some embodiments the projectile 100 comprises additional features. In one embodiment the projectile 100 comprises an audio location device. An audio location device is a device which emits a sound so that the projectile 100 can be located by the user. Virtually any device which emits a sound can be utilized. In another embodiment the projectile 100 comprises a visual location device. A visual location device is a device which uses flashes of lights, contrast of light, or other such visual stimulant to allow a user to retrieve a projectile 100. In one embodiment the visual location device includes a portion of the projectile 100 which glows. The glowing can be achieved via a chemical coating. In one embodiment the projectile 100 comprises a portion which is transparent or translucent.

Another additional feature is a camera. In one embodiment the projectile 100 comprises a camera which can record audio, video, and/or combinations thereof during the flight of the projectile 100. Further, in one embodiment the projectile 100 is equipped with GPS capability so that the location of the projectile 100 can be determined.

An additional feature is an electromagnetic transmitter or transceiver which can be located on the projectile 100.

In one embodiment at least a portion of the projectile 100 comprises computer generated images ("CGI") symbols referred to as markers. Markers are trackable symbols which allow film makers to track and modify an area which comprises the markers with CGI software and the like. For example, in one embodiment the head 106 comprises markers. The film makers can then shoot the projectile 100, track the markers, and use CGI to replace the safe head 106 of the projectile 100 with a vicious looking arrow head, for example. Thus, this allows film makers to shoot real, but safe, arrows at actors and subsequently replace the head 106 with CGI.

In one embodiment the projectile 100 comprises a whistle. The whistle can be located anywhere on the projectile 100 but in one embodiment is located on the shaft. The whistle is designed such that when wind passes by the whistle, a whistling sound is played. This allows the user to track and hear the projectile 100 flying through the air.

In another embodiment the projectile 100 comprises small loose particles, such as sand. The loose particles can be located anywhere in the projectile 100, and in one embodiment are located within the shaft 104. When shot or otherwise moved, the sand within the projectile 100 makes a swishing sound similar to the sound of a hula hoop. This provides an interesting sound and allows a user to track a projectile 100.

As noted, the projectile 100 can comprise a wide variety of materials with a wide variety of hardness for each material. The Shore A hardness scale is one of several different measures of the hardness of a given material. The hardness of a material is the material's resistance to permanent indentation. In one embodiment the sheath 112 comprises a hardness of between about 30 and 60 on the Shore A hardness scale. In one embodiment the shock absorber 101 comprises a hardness between about 10 and 30 on the Shore A hardness scale. In one embodiment the penetration prevention device 102 comprises a hardness of between about 80 and 100 on the Shore A hardness scale. In one embodiment the cuff 103 comprises a hardness of between about 70 and 100 on the Shore A hardness scale. In one embodiment the shaft 104 comprises a hardness of between about 80 and 100 on the Shore A hardness scale. In one embodiment the tail 107 comprises a hardness of between about 60 and 100 on the Shore A hardness scale.

Figure 8:
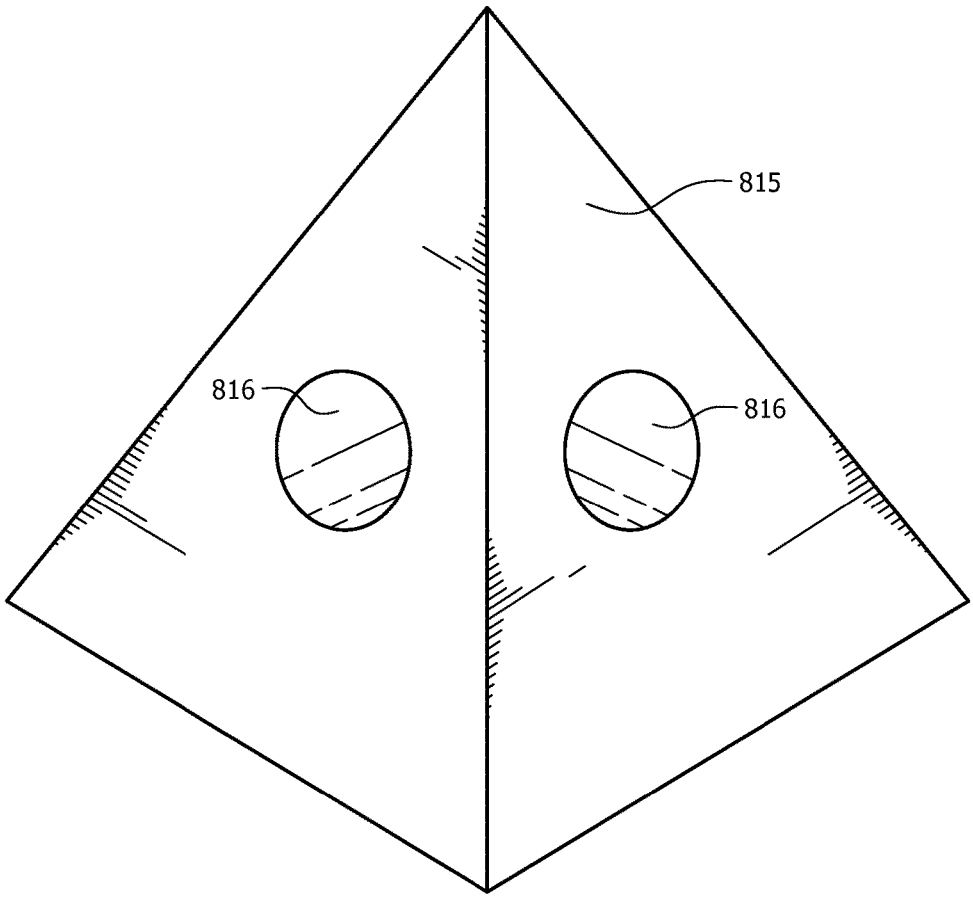
FIG. 8 is a perspective view of a goal in one embodiment.

As noted, in one embodiment the modified projectile 100 is used for target practice or in a game. However, in one embodiment wherein the projectile 100 is non-penetrating, determining the location of the shot is often difficult. This is contrasted to a penetrating arrow, for example, which remains lodged in the target. Consequently, in one embodiment a goal is disclosed which captures and immobilizes a shot projectile 100. FIG. 8 is a perspective view of a goal 815 in one embodiment. In one embodiment the goal 815 is a rigid or semi-rigid structure with one or more apertures 816 such as pockets or channels into which the projectile 100 can be shot and immobilized. In operation, the user attempts to shoot the projectile 100 into the aperture 816. In one embodiment, the goal 815 and the aperture 816 immobilize the projectile 100 so that it can be determined if the shot successfully hit its mark. A user will be able to walk to the goal 815 to retrieve the projectile 100 from the aperture 816. Because the aperture 816, in one embodiment, is open, the projectile 100 enters the aperture 816 rather than penetrating through the aperture 816.

In one embodiment the size of the aperture 816 varies to provide varying level of difficulty. For example, a smaller aperture 816 can be more difficult to hit compared to a larger aperture 816. In one embodiment a goal 815 comprises at least two apertures 816 of different diameters. In a game, hitting a smaller aperture 816 can be scored higher than hitting a larger aperture 816.

The goal 816 is depicted as pyramidal but that shape is not limiting. Other shapes include, but are not limited to, spheroid, dome, tetrahedron, cuboid, dodecahedron, parallelepipedal, and virtually any three dimensional shape.

As noted, the aperture 816, in one embodiment, immobilizes the projectile 100 with immobilizers. The immobilizers can comprise any device which absorbs the momentum of the projectile 100 and stops the projectile 100. Examples of immobilizers include teeth, flaps, doors, gates, strings, etc. which contacts and stops the projectile 100. The immobilizers can be made of virtually any material including cloth, elastomeric materials, plastic, rubber, hay, etc. In one embodiment the goal is stuffed with the immobilizers. In one embodiment the immobilizers stop the projectile 100 so that the projectile 100 jets out from the aperture 816 so as to be visible from the shooter.

The goal 815 can sit on or be tethered the ground or can be elevated in the air. The goal 815 can be elevated with any device including wire, string, etc. The goal 815 can be made of fabric, cloth, plastic, rubber, and virtually any material.

While one embodiment has been described wherein the projectile 100 is immobilized and held in place, in other embodiment the projectile 100 is immobilized and then allowed to fall into a tray or basket for subsequent retrieval. For example, in one embodiment the goal 815 comprises a trap tray similar to those used in Frisbee golf courses. In such a tray, the immobilizers are strands of chains hanging from an elevated ring which are above a wide circular tray. The tray can catch a projectile 100 after impact with the immobilizers. Likewise, in one embodiment the goal 815 comprises a goal situated above a basket whereby projectiles 100 are immobilized and then deposited into a basket. In still other embodiments, the goal 815 can comprise a basket.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

1. A projectile comprising:

a head, wherein said head comprises a shock absorber coupled to a penetration prevention device;

an elongated shaft coupled to said head;

a tail coupled to the rear of said elongated shaft, wherein said tail comprises a mechanical adapter.

2. The projectile according to clause 1 wherein said projectile further comprises a flight drag.

3. The projectile according to clause 2 wherein said flight drag is located on said head.

4. The projectile according to any preceding clause further comprising a sheath, wherein said sheath covers said head.

5. The projectile according to any preceding clause wherein said sheath has a front end located at the front of said head and a rear end adjacent to said elongated shaft, wherein said rear end comprises a tapered shape.

6. The projectile according to any preceding clause wherein said mechanical adapter comprises a nock.

7. The projectile according to any preceding clause further comprising a cuff.

8. The projectile according to any preceding clause wherein said head comprises variable rigidity layers.

9. The projectile according to any preceding clause wherein said head comprises channels.

10. The projectile according to any preceding clause further comprising an audio location device.

11. The projectile according to any preceding clause further comprising a visual location device.

12. The projectile according to any preceding clause wherein said projectile comprises an arrow.

13. The projectile according to any preceding clause wherein said penetration prevention device comprises a diameter, wherein said shaft comprises a diameter, and wherein the diameter of said penetration prevention device is greater than the diameter of said shaft.

14. The projectile according to any preceding clause wherein said penetration prevention device comprises at least two holes.

15. The projectile according to any preceding clause wherein said penetration prevention device and said shaft are integrally made.

16. The projectile according to any preceding clause wherein said tail comprises a blunted end.

17. The projectile according to any preceding clause wherein said projectile comprises a non-penetrating projectile.

18. The projectile according to any preceding clause wherein said penetration prevention device comprises an annular shape.

19. The projectile according to clause 18 wherein said penetration prevention device comprises spokes.

20. The projectile according to any preceding clause wherein said shock absorber comprises an annular shape.

21. The projectile according to any preceding clause wherein said tail is shaped as a flight drag.

22. A target for receiving a projectile, said target comprising:

a structure with at least one aperture located on the external surface of said target; and an immobilizer for immobilizing a projectile which has entered said aperture.

23. A system for shooting a projectile at a target, said system comprising:

a projectile, wherein said projectile comprises a head, an elongated shaft coupled to said head, and a tail coupled to the rear of said elongated shaft, wherein said tail comprises a mechanical adapter, and wherein said head comprises a shock absorber coupled to a penetration prevention device;

a target for receiving said projectile, said target comprising a structure with at least one aperture located on the external surface of said target, and an immobilizer for immobilizing a projectile which has entered said aperture.

24. A projectile comprising:

a head, an elongated shaft coupled to said head;

a tail coupled to the rear of said elongated shaft, wherein said tail comprises a mechanical adapter, wherein said head comprises variable rigidity layers.

25. The projectile according to clause 24 wherein said variable rigidity layers comprises a first inner hard layer, wherein said inner hard layer is topped by an adjacent second layer, wherein said second layer is less hard than said first inner hard layer, and wherein said second layer is topped by an adjacent third layer, wherein said third layer is less hard than said second layer.

What is claimed is:

1. A projectile comprising:

a head, wherein said head comprises a shock absorber coupled to a penetration prevention device;

an elongated shaft coupled to said head;

a tail coupled to the rear of said elongated shaft, wherein said tail comprises a mechanical adapter;

wherein said shock absorber comprises an elastomeric compound;

said tail comprises a blunted end, and wherein said blunted end comprises an end without sharp corners or edges;

wherein said penetration prevention device comprises a diameter, wherein said shaft comprises a diameter, and wherein the diameter of said penetration prevention device is greater than the diameter of said shaft;

and wherein said penetration prevention device comprises a flat and rigid plate;

and wherein said projectile further comprises a sheath, and wherein said sheath covers said head, and wherein said sheath prevents pieces of said head from becoming dislodged during flight;

wherein said sheath remains attached to said head in use during flight;

wherein said shock absorber is further from said tail than said penetration prevention device is away from said tail;

wherein said sheath covers said shock absorber and said penetration prevention device, and wherein said sheath prevents either said shock absorber or said penetration prevention device from becoming dislodged during flight and impact.

2. The projectile of claim 1 wherein said mechanical adapter comprises a nock.

3. The projectile of claim 1 further comprising a cuff.

4. The projectile of claim 1 wherein said penetration prevention device and said shaft are integrally made.

5. The projectile of claim 1 wherein said blunted end comprises a rounded end, and wherein said projectile is non-deadly.

6. The projectile of claim 1 wherein said sheath is on the fore end of said projectile.

7. The projectile of claim 1 wherein said shock absorber is adjacent to said penetration prevention device, and wherein said projectile does not penetrate humans.

8. The projectile of claim 1 wherein said shock absorber is on a far distal end of said projectile from said tail.

* * * * *